US006182622B1

(12) United States Patent
Goloyatai-Schmidt et al.

(10) Patent No.: US 6,182,622 B1
(45) Date of Patent: Feb. 6, 2001

(54) DEVICE FOR THE RELATIVE ROTATION OF A CAMSHAFT RELATIVE TO A CRANKSHAFT THAT DRIVES THE CAMSHAFT IN AN INTERNAL COMBUSTION ENGINE

(75) Inventors: Eduard Goloyatai-Schmidt, Röttenbach; Rainer Ottersbach, Bonn, both of (DE)

(73) Assignee: INA Walzlager Schaeffler oHG (DE)

( * ) Notice: Under 35 U.S.C. 154(b), the term of this patent shall be extended for 0 days.

(21) Appl. No.: 09/425,681

(22) Filed: Oct. 22, 1999

(30) Foreign Application Priority Data

Oct. 22, 1998 (DE) ..... 198 48 706

(51) Int. Cl.[7] ..... F01L 1/344
(52) U.S. Cl. ..... 123/90.15; 123/90.37
(58) Field of Search ..... 123/90.15, 90.17, 123/90.31, 90.37, 90.38; 74/568 R

(56) References Cited

U.S. PATENT DOCUMENTS 5,012,774 * 5/1991 Strauber et al. ..... 123/90.17
5,111,780 * 5/1992 Hannibal ..... 123/90.17
5,201,289 * 4/1993 Imai ..... 123/90.17
5,205,249 * 4/1993 Markley et al. ..... 123/90.17
5,263,442 * 11/1993 Hara ..... 123/90.17
5,447,126 * 9/1995 Kondoh et al. ..... 123/90.17
5,875,751 * 3/1999 Strauss et al. ..... 123/90.17
5,988,126 * 11/1999 Strauss et al. ..... 123/90.17

FOREIGN PATENT DOCUMENTS 196 11 365 A1 9/1997 (DE) .
197 10 869 A1 9/1998 (DE) .

* cited by examiner

*Primary Examiner*—Wellun Lo
(74) *Attorney, Agent, or Firm*—Volpe & Koenig, PC

(57) ABSTRACT

A device (1) for the relative rotation of a camshaft (5) relative to a crankshaft which drives the camshaft, which is arranged on the drive-side end (4) of the camshaft (5) which projects into a chain bay (2) is provided and essentially consists of a hydraulic adjusting drive. The device (1) includes a structural component (6) affixed to the crankshaft and a structural component (7) connected to the camshaft so that it is rotationally fixed to it. Both structural parts can then be rotated or fixed relative to each other using a hydraulic pressure agent acting upon two pressure chambers (8, 9) that are constructed within the device (1). The pressure agent supply and return can be controlled by a hydraulic control component (12) arranged in a cavity (10) of an axial structural component (11) of the device (1) and activated by an adjusting element (14) attached to a housing part (13) of the chain bay (2). According to the invention, the hydraulic control element (12) of the device is constructed as a fixed hydraulic part of an adjustable hydraulic valve (15), and is arranged starting from its control element (14) attached to the housing part (13) of the chain bay (2), projecting into the cavity (10) of the axial structural part (11) of the device (1).

8 Claims, 2 Drawing Sheets

DEVICE FOR THE RELATIVE ROTATION OF A CAMSHAFT RELATIVE TO A CRANKSHAFT THAT DRIVES THE CAMSHAFT IN AN INTERNAL COMBUSTION ENGINE

BACKGROUND OF THE INVENTION

The invention involves a device for the relative rotation of a camshaft relative to a crankshaft that drives the camshaft in an internal combustion engine, in which the device is attached on a drive-side end of the camshaft and projects into a chain bay of a cylinder head of the engine. The device includes a hydraulic adjusting drive with a structural component that is adapted to be drivingly connected with the crankshaft of the internal combustion engine and a second structural component adapted to be connected to the camshaft in a rotationally fixed manner. The structural component which is adapted to be drivingly connected to the crankshaft is in force-transferring connection with the second structural component that is affixed to the camshaft, and can be acted upon alternatingly or simultaneously by a hydraulic pressure agent via two pressure chambers located within the device such that the structural parts can be rotated or fixed in position relative to each other. The pressure agent supply and return to and from the pressure chambers are controlled by a hydraulic control component arranged coaxially to a longitudinal axis of the camshaft in a cavity of an axial structural component of the device. The hydraulic control element is activatable through an adjusting element attached to an opposing housing part of the chain bay in a position aligned with an extension of the camshaft longitudinal axis as a function of the operating parameters of the internal combustion engine.

A device of this type that forms the generic concept is previously known from German Patent DE-OS 196 11 365. This device, essentially constructed as a hydraulic adjustment mechanism, is arranged on the drive-side end of the camshaft which projects into a chain bay of the cylinder head of the internal combustion engine and consists of a structural component affixed to the crankshaft that is driven in connection with the crankshaft of the internal combustion engine and a structural component that it is rotationally fixed to the camshaft. The structural component affixed to the crankshaft is in force-transferring connection with the structural component that is fixed to the camshaft, where both of them are constructed with helical gearing into which an adjustment piston meshes. The adjustment piston has complementary helical gearing and is arranged inside the device and can be moved axially. Through the use of two pressure chambers that are constructed within the device and can be acted upon alternatingly or simultaneously with a hydraulic pressure agent, and which are separated from each other by the adjustment piston, both structural parts can then be rotated or fixed and cause a relative rotation or an infinitely variable hydraulic fixing of the camshaft relative to the crankshaft. The pressure agent supply and return to and from the pressure chambers of the device can in addition be controlled by a hydraulic control component arranged coaxially to the camshaft longitudinal axis in a cavity of an axial structural component of the device, where the axial structural component is constructed as a mounting bolt, having a hollow shaft part, for the structural component affixed to the camshaft, and can be screwed into a threaded bore hole arranged coaxially to the camshaft longitudinal axis. The hydraulic control element is formed from an axially movable control piston that is arranged in the hollow shaft part of the mounting bolt and rotates together with the device and is connected to an adjusting element via a tappet push rod. This adjusting element that is activated as a function of the operating parameters of the internal combustion engine is attached to a housing part of the chain bay lying opposite in the extension of the camshaft longitudinal axis, and is constructed as an electromagnet that acts against the force of a restoring spring.

It is disadvantageous in this known device that its hydraulic control element and its adjusting element or its electromagnet and its armature that is connected to the control piston, are attached or positioned on two different structural parts of the internal combustion engine, namely on the one hand, on the fixed chain bay housing and on the other hand, on the rotating cam shaft end, and thus are subject to many perturbation factors which can negatively affect the accurate combined interaction of these elements, which is necessary for the functioning of the device, or are the cause of internal pressure agent leakages or malfunctions of the device. Thus, for example, because of the, for the most part, very coarse position tolerances both in the radial as well as in the axial directions, between the chain bay housing and the camshaft ends, it is only possible by relatively expensive centering measures, to mount the electromagnets with the necessary accurate axial and radial air gaps on this armature in the chain bay housing. On the other hand, in spite of axially accurate positioning of the electromagnets relative to this armature, it is unavoidable that by perturbation factors acting in the radial direction during the operation of the internal combustion engine, such as for example, by the camshaft-bearing play and/or by a deflection of the camshaft end and/or the tension of the drive chain, the radial air gap of the armature to the electromagnets becomes asymmetrical so that the armature is more strongly magnetically attracted on one side and at least makes control of the regulated positions of the control pistons more difficult, or in the worst case, becomes impossible by unbalancing or clamping of the control piston. In addition, the perturbation factors acting in the axial direction during the operation of the internal combustion engine, such as for example, the axial vibrations of the camshaft which come from the valve operations of the internal combustion engine, or the temperature-dependent expansions of the chain bay housing and the camshaft, negatively influence the force equilibrium between the electromagnets and the restoring spring of the control piston acting against them, or the hysteresis and the response sensitivity of the electromagnets, so that an exact control of the hydraulic resistances or the pressure agent inflow and outflow to and from the pressure chambers of the device is only possible by a corresponding overdimensioning of the electromagnets. This overdimensioning of the electromagnets has, however, proven in view of the increased manufacturing costs for a device of this type, to be disadvantageous, and can also not completely eliminate the disadvantageous effects resulting from the axial and radial interference factors, so that internal pressure agent leakages and/or hydraulic leakages between the pressure chambers of a device of this type can not be further ruled out.

SUMMARY OF THE INVENTION

The purpose of the invention is therefore to design a device for the relative rotation of a camshaft relative to a crankshaft that drives the camshaft in an internal combustion engine, in which internal pressure agent leakages between the hydraulic control element and the device can be reduced to a minimum, so that the hydraulic control element can be positioned on the one hand, without expensive centering measures between this adjusting component and its control piston in the device, and on the other hand, should remain in its function unaffected by the radial and axial perturbation factors that occur during the operation of the internal combustion engine.

According to the invention, this purpose is achieved in a device attached on a drive-side end of the camshaft which projects into a chain bay of a cylinder head of the engine, and having a hydraulic adjusting drive. The device includes a structural component that is adapted to be drivingly connected with the crankshaft of the internal combustion engine and a structural component adapted to be connected to the camshaft in a rotationally fixed manner. The structural component which is adapted to be drivingly connected to the crankshaft is in force-transferring connection with the structural component that is affixed to the camshaft, and can be acted upon alternatingly or simultaneously by a hydraulic pressure agent through two pressure chambers located within the device such that the structural parts can be rotated or fixed in position relative to each other. The pressure agent supply and return to and from the pressure chambers are controlled by a hydraulic control component arranged coaxially to a longitudinal axis of the camshaft in a cavity of an axial structural component of the device. The hydraulic control element is activatable through an adjusting element attached to an opposing housing part of the chain bay in a position aligned with an extension of the camshaft longitudinal axis as a function of the operating parameters of the internal combustion engine. The hydraulic control element of the device is constructed as a fixed hydraulic part of an adjustable hydraulic valve, which is arranged starting from its control element which is attached to the housing part of the chain bay, projecting into the cavity of the axial structural part of the device. This hydraulic control element has a housing attached to the control element having at least three radial openings distributed over its circumference as well as axially displaced from each other, which are separated from each other hydraulically by at least four ring-shaped sealing components that enclose the hydraulic control element. The axial structural component of the device has at least three opposing radial bore holes that are distributed over its outer sheath surface and are also axially displaced from each other, opening into its cavity, which are provided for the pressure agent supply and return to and from the pressure chambers of the device. The sealing components of the hydraulic control elements thus form together with the inner wall of the cavity of the axial structural part, several ring chambers, through which every one of the at least three radial bore holes in the axial structural part of the device is each hydraulically connected to one of the at least three radial openings in the hydraulic control element.

In a further practical embodiment of the device according to the invention, the adjusting component of the hydraulic control element is thus constructed as an electromagnet in a known way, preferably by a directly controlled proportional directional valve, which consists of a hollow cylindrical cartridge and a control piston that can be moved axially inside it. It is, however, also possible, instead of the proportional directional valve, to use a single switching valve as a hydraulic control element and/or instead of the electromagnets, an adjusting motor as the control element of the hydraulic control element. The hollow cylindrical cartridge is thus constructed as the housing of the hydraulic control element, which has the at least three radial openings distributed over the circumference, where, however, these at least three radial openings, just like the at least three radial bore holes on the outer sheath surface of the axial structural component, only represent the minimum number necessary for the hydraulic circulation of the device, i.e. at least one inflow to the pressure chamber(s), at least one inflow to the other pressure chamber(s) and at least one outflow from all of the pressure chambers are necessary for the functioning of the device. In regard to the fastest possible switch times of the device according to the invention, it has proven to be advantageous, on the other hand, instead of only three radial openings and three radial bore holes, to arrange three ring-shaped rows of radial openings and radial bore holes in the housing of the adjusting element and in the axial structural component of the device, respectively. The radial openings in the housing of the adjusting element are preferably also constructed in the form of uniformly spaced bore holes, each of which, however, can have any other desired passage form.

An additional characteristic of the device according to the invention is that the axial structural part of the device constructed with the cavity for receiving the hydraulic control element is made through a mounting bolt for the rotationally fixed connection of the structural component affixed to the camshaft, which can be screwed into a threaded bore hole in the camshaft arranged coaxially to the camshaft longitudinal axis. This mounting bolt then has on its threaded part an increased diameter shaft part, in which the cavity constructed as an axial base bore hole is arranged for the hydraulic control element. In this manner, the increased diameter shaft part of the mounting bolt has a smaller diameter than the camshaft, in order to be able to clamp the structural part, affixed to the camshaft and arranged on the increased diameter shaft part, of the device according to the invention, through the head of the mounting bolt against the face side of the drive-side end of the camshaft.

As an alternative, it is also possible, however, to form the actual axial structural part of the device, constructed with the cavity for receiving the hydraulic control element, through the drive-side end of the camshaft, whereby this end is constructed with an extension, in which the cavity also constructed as an axial base bore hole is arranged for the hydraulic control element. The end area of the drive-side end of the camshaft is thereby constructed with a slightly reduced diameter and has a threaded section for the rotationally fixed connection of the structural part of the device to the camshaft, to which a ring-shaped mounting nut can be screwed. The structural part of the device according to the invention affixed to the camshaft and arranged in the reduced diameter end area can thus be braced by the mounting nut in the same way, against a ring shoulder of the camshaft which comes from the diameter reduction of the drive-side end of the camshaft.

Furthermore, it is proposed to use the motor oil from the lubricant circulation system of the internal combustion engine in a known way as a hydraulic pressure agent for acting on the pressure spaces of the device. The supply of this pressure agent to the hydraulic control element or to the pressure spaces of the device is done in an advantageous manner in that starting from the available oil supply for the lubrication of a device-side camshaft slide bearing in the cylinder head of the internal combustion engine, a portion of the motor oil is branched off via radial bore holes in the camshaft into an axial channel in the camshaft. Depending on the embodiment of the axial structural part of the device, constructed with the hollow space for the hydraulic control element, as a mounting bolt or as an extension of the camshaft itself, the motor oil is then either directed further by this axial channel in the camshaft through an axial throughput bore hole in the threaded part of the mounting bolt, or directed further directly into the cavity in the axial structural part of the device. From this cavity, the motor oil then travels via a face side bore hole in the housing of the hydraulic control element into the inside of it, from which, depending on the position of the control piston of the hydraulic control element which is adjustable as a function of the operating parameters of the internal combustion engine, the oil is either directly supplied to a (row of) radial opening(s) in the housing of the hydraulic control element or via the preferred hollowbored control piston, to the other (row of) radial opening(s) in the housing of the hydraulic control element, or in the controlled positions of the control piston, to both (rows of) radial openings. Through the corresponding ring chambers between the hydraulic control component and the inner wall of the axial structural component, as well as by the corresponding radial bore holes in the axial structural component of the device and the channels connecting to it in the structural part of the device that is affixed to the camshaft, the one or the other of the pressure space(s) of the device or all at the same time are acted upon by the hydraulic pressure agent, which is carried off again via the third (row of) radial opening(s) as well as via other bore holes and channels connected to them, preferably into the chain bay of the cylinder head of the internal combustion engine.

Finally, it is also proposed in another embodiment of the device according to the invention, that the sealing elements surrounding the hydraulic control element are constructed out of a material that is resistant to shearing and are also constructed with a pretension and are arranged in surrounding ring grooves on the circumference of the hydraulic control element. By this pretension of the sealing elements, a radial force is thereby generated, which together with a radial force component of a dynamic sealing force resulting from pressure differences between the ring chambers formed, seals off the pressure agent leakages between the sealing elements and the inner wall of the cavity of the axial structural part. At the same time, an axial force component of the dynamic sealing force resulting from the pressure differences makes it so that pressure agent leakages between the sealing components and the hydraulic control element are also avoided. It has proven to be especially advantageous to construct the sealing elements as slit steel sealing rings with a square or right angled cross-section, having an outer diameter that can be reduced while generating a pretension at least to the diameter of the cavity of the axial structural part of the device. Also included in the scope of the present invention, however, are sealing rings made of other materials resistant to shearing, such as plastics, brass, copper, or alloys of them, which have a certain elasticity when their slits or their ring ends are pressed together radially, or they build a separate pretension. As the most favorable form of slits in the sealing rings, slits running in a sloped manner or in graduations from one axial surface to another axial surface, in themselves known, have proven to be effective, in order to prevent pressure agent leakages via the slits. In a like manner, the square or rectangular cross-section of the sealing rings is only to be considered to be a preferred cross section, and they can also be carried out in any other possible shape. The straight axial and radial surfaces of square or rectangular ring cross-sections, however, offer both the most effective sealing surface for the inner wall of the cavity of the axial structural part as well as the most effective pressure working surfaces for generating the dynamic sealing force of the sealing components through the hydraulic pressure agent. A further prerequisite for generating this dynamic sealing force of the sealing components is that they preferably have radial and axial play to the respective ring groove in the hydraulic control element. This can be carried out when they are constructed with a larger inner diameter than the ring groove inner diameter and have a smaller thickness than the ring groove width. In this way, the pressure of the hydraulic pressure agent can act on both the part of the axial surfaces of the sealing components arranged in each ring groove as well as on the inner radial surface of the sealing component, and seal the sealing components automatically according to the direction of pressure against one of the axial walls of the ring grooves and against the inner wall of the cavity of the axial structural part.

The device according to the invention for the relative rotation of a camshaft relative to a crankshaft of an internal combustion engine driving the camshaft thus has, relative to the devices known from the state of the art, the advantage that its hydraulic control element and its adjusting element are only affixed to one single structural component of the internal combustion engine, namely on the chain bay housing of the cylinder head, and are constructed without an expensive rotating transfer to each other as a single fixed hydraulic valve. By this fixed arrangement of the hydraulic control element only projecting into the device, time-consuming centering measures between the electromagnets and the armature of the adjusting component as well as an expensive overdimensioning of the electromagnets are unnecessary, since the occurrence of asymmetrical axial and/or radial air gaps between the electromagnets and the armature, by position tolerances between the chain bay housing and the camshaft end or by the radial and axial perturbation factors occurring during the operation of the internal combustion engine, is no longer possible. Thus, both an unbalancing or clamping of the control piston of the hydraulic control element as well as a negative influencing of hysteresis and response sensitivity of the electromagnets is ruled out and at any time, and an exact control of the hydraulic resistances or the pressure agent flow and return to and from the pressure chambers of the device is possible. The position tolerances occurring in internal combustion engines with the device constructed according to the invention, between the chain bay housing and the camshaft end, as well as the radial and axial interference factors are offset in an advantageous way by the sealing elements surrounding the hydraulic control element, so that internal pressure agent leakages between the hydraulic control element and the device are reduced in a simple way to a minimum, and malfunctions of the device are ruled out.

BRIEF DESCRIPTION OF THE DRAWINGS

The invention is explained in greater detail in the following in connection with two preferred embodiments of the invention which are shown in the corresponding drawings, wherein.

DETAILED DESCRIPTION OF THE INVENTION

Figure 1:
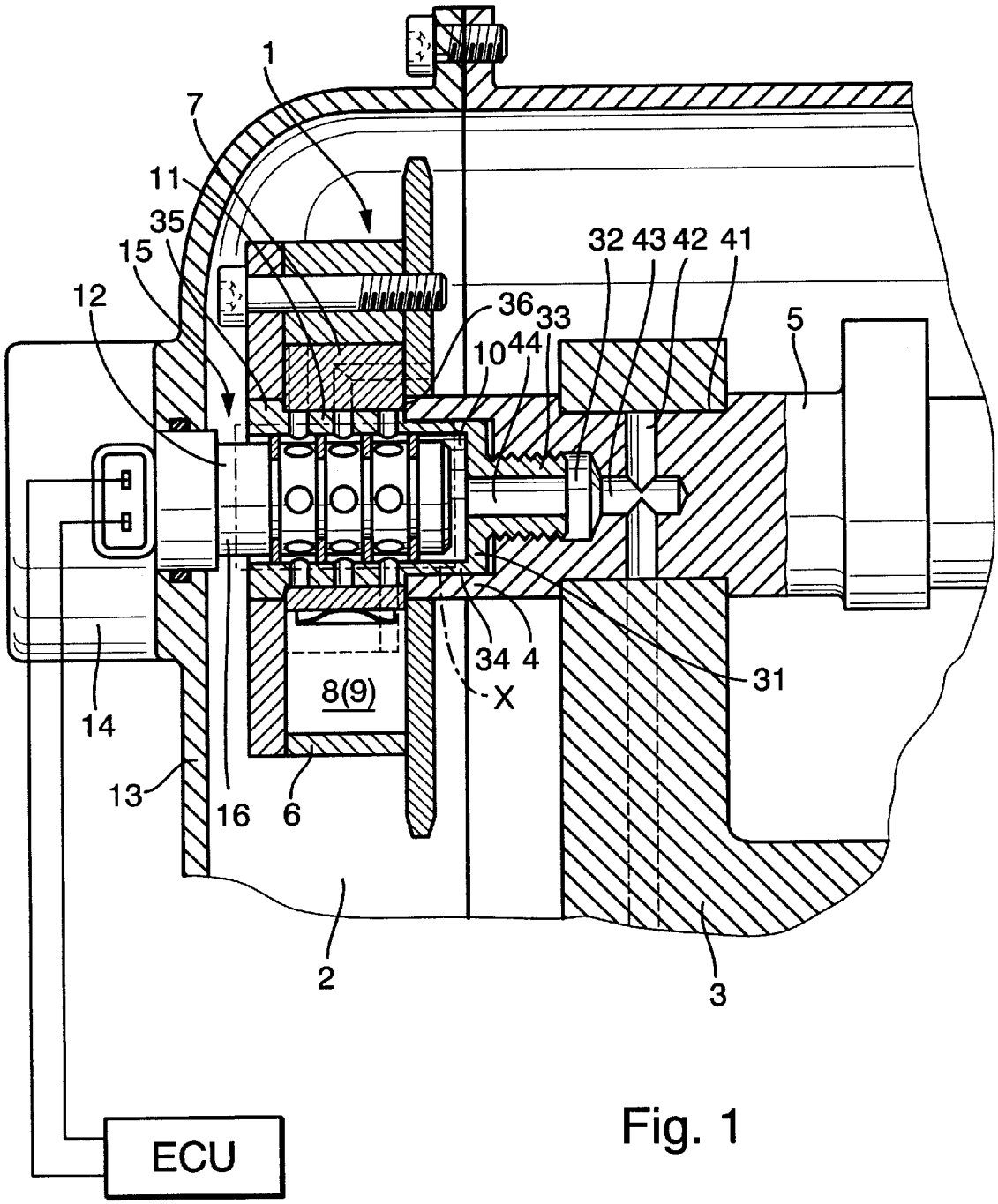
FIG. 1 is a partial view of a longitudinal section through the cylinder head of an internal combustion engine along the camshaft longitudinal axis with a first embodiment of a device constructed according to the invention.
Figure 2:
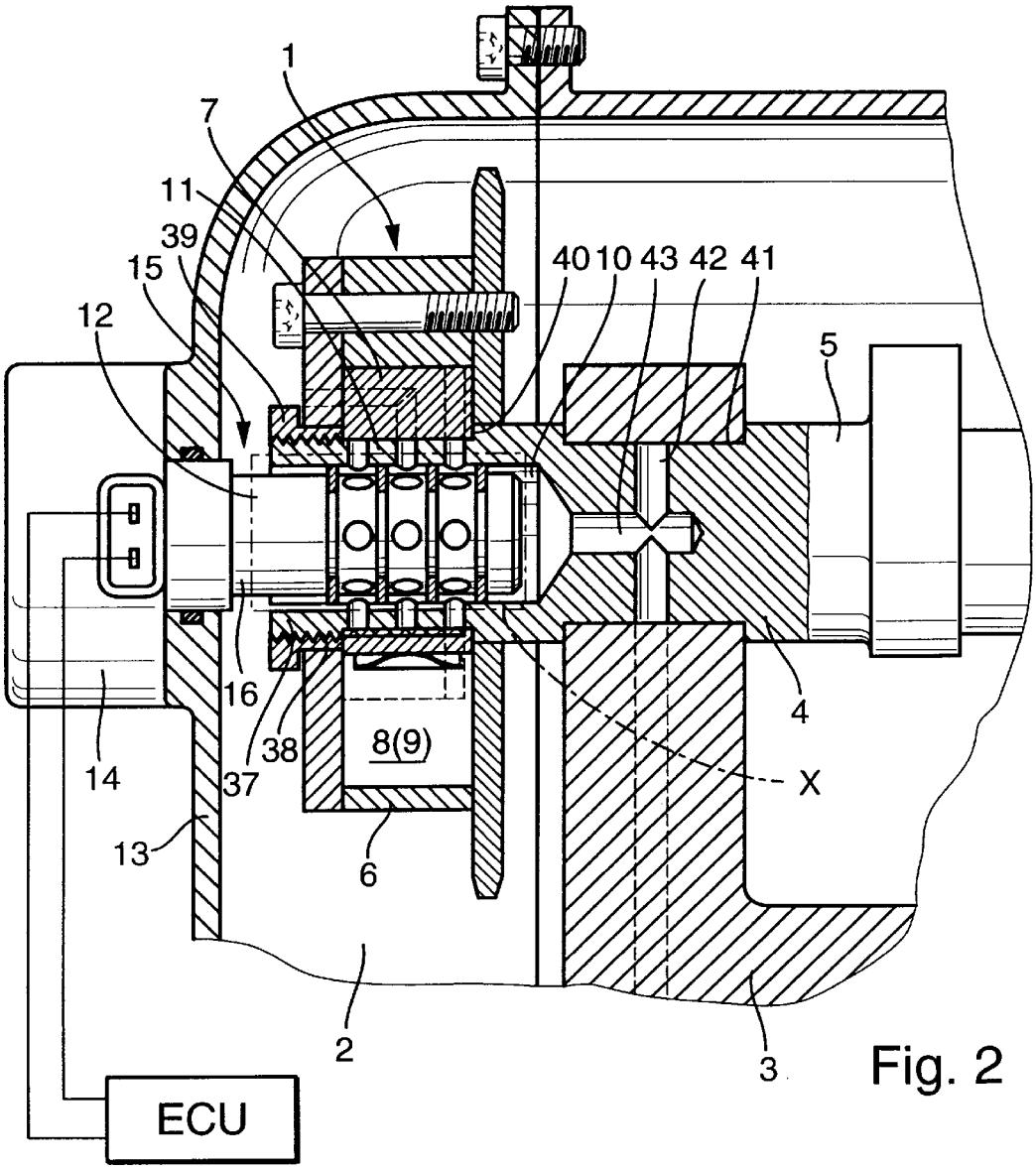
FIG. 2 is a partial view of a longitudinal section through the cylinder head of an internal combustion engine along the cam shaft longitudinal axis, with a second embodiment of a device constructed according to the invention.

In each of FIGS. 1 and 2, a device 1 is shown for relative rotation of a camshaft 5 relative to a crankshaft of an internal combustion engine that drives the camshaft 5, with which the opening and closing times of the gas exchange valves of an internal combustion engine can be changed. This device 1 is arranged in a known way on the drive-side end 4 of the camshaft 5 that projects into a chain bay 2 of the cylinder head 3 of the internal combustion engine, and is depicted in both FIGS. 1 and 2, for example, as a vane-type adjusting device. However, those skilled in the art will recognize that other types of adjusting mechanisms, in themselves known, essentially acting as hydraulic adjusting drives may be used. Independently of the type, however, each one these devices 1 consists of a structural component 6 drivingly connected with the crankshaft (not shown in greater detail) of the internal combustion engine, and of a structural part 7 that is connected in a rotationally fixed manner with the camshaft 5, where these parts are formed in the device 1 shown, by a stator that is bolted to a timing gear and a housing cover (not shown in greater detail) and also by a rotor constructed with several radial blades, which is also not shown in greater detail. The structural part 6 affixed to the crankshaft of the device 1, is in a force transmitting connection with its structural part 7 affixed to the camshaft, and both structural parts 6, 7 can be rotated or fixed relative to each other via at least two pressure chambers 8, 9 that are formed within the device 1 and can be acted upon alternatingly or simultaneously by a hydraulic pressure agent, with the pressure chambers 8,9 being arranged on both sides of the blades (not shown in greater detail) in the device 1 depicted in FIGS. 1 and 2. The pressure agent supply and return to and from the pressure chambers 8, 9 can be controlled in the definite case by a hydraulic control element 12, which is arranged coaxially to the camshaft longitudinal axis in a cavity 10 of an axial structural part 11 of the device 1 and can be activated by an adjustment element 14 attached to a housing part 13 of the chain bay 2 lying opposite, as a function of different operating parameters of the internal combustion engine.

In FIGS. 1 and 2, it can be clearly recognized that the hydraulic control element 12 according to the invention is constructed as a fixed, hydraulic part of a hydraulic valve 15 controlled by a control unit indicated by ECU, which projects starting from its adjusting element 14 attached on the housing part 13 of the chain bay 2, into the cavity 10 of the axial structural part 11 of the device 1. This hydraulic control element 12 has a housing that is rigidly attached to this adjusting element 14, where the control element 14 is constructed in a known way as an electromagnet and the hydraulic control element 12 is constructed as a directly controlled proportional directional valve, which consists of a hollow cylindrical cartridge and a control piston that can be moved axially inside it. In the housing 16 formed by the cartridge, there are, as can be seen from the enlarged representation of detail X in FIG. 3, three rows consisting of several radial bore holes distributed over its circumference, as well as rows of axially displaced radial openings 17, 18, 19 consisting of several radial bore holes, which are hydraulically separated from each other by four ring-shaped sealing elements 20, 21, 22, 23 that surround the hydraulic control element 12. As can be seen more clearly from FIG. 3, opposite to these openings, the axial structural component 11 of the device 1 also has three rows of axially displaced radial bore holes 24, 25, 26 that are distributed over its outer sheath surface and open into the cavity 10 of structural part 11, which are provided for the supply and return of pressure agent to and from the pressure chambers 8, 9 of the device 1. The sealing elements 20, 21, 22, 23 of the hydraulic control element 12 thus form together with the inner wall 27 of the cavity 10 of the axial structural component 11, several ring chambers indicated in FIG. 3 by 28, 29, 30, so that every one row of radial bore holes 24, 25, 26 in the axial structural part 11 of the device 1 is connected to a row of radial openings 17, 18, 19 in the housing 16 of the hydraulic control element 12.

In FIG. 1, it can be further recognized that the axial structural component 11 of the device 1, constructed with the cavity 10 for receiving the hydraulic control element 12, is formed in a first embodiment form by a mounting bolt 31, with which the structural component 7, affixed to the camshaft, of the device 1, is mounted onto the camshaft 5 so that it does not rotate. This mounting bolt 31 can be screwed into a threaded hole 32 in the camshaft 5 arranged coaxially to the camshaft longitudinal axis and has in addition on its threaded part 33, a shaft part 34 that increases in diameter, in which the cavity 10 is formed in as an axial bore hole. It can be clearly seen that this enlarged diameter shaft part 34 has a smaller diameter than the camshaft 5, so that the structural component 7 affixed to the camshaft arranged on the shaft part 34 of the mounting bolt 31 can be mounted by the head 35 of the mounting bolt 31 against the face side 36 of the drive-side end 4 of the camshaft 5.

Alternatively, in the second embodiment of the invention depicted in FIG. 2 it is shown that axial structural part 11 of the device 1 constructed with the cavity 10 to receive the hydraulic control element 12 can also be formed directly in the drive-side end 4 of the camshaft 5. For this purpose, the drive-side end 4 of the camshaft 5 is constructed to be extended in comparison to the first embodiment, and it is provided from its face side with the cavity 10 that is also made as an axial bore hole. The end area 37 of the extended drive-side end 4 of the camshaft 5, furthermore, has a clearly visibly reduced diameter relative to the main portion of the camshaft 5 and is provided with a threaded section 38, onto which a ring-shaped attachment nut 39 can be screwed for the rotationally fixed connection of the structural component 7 to the camshaft 5. In this way, the structural component 7 of the device 1 affixed to the camshaft and arranged on the reduced diameter end area 37, can be mounted in the same manner against a ring shoulder 40, which results from the diameter reduction of the camshaft 5.

Furthermore, it is understood from FIGS. 1 and 2, that as a hydraulic pressure agent for acting upon the pressure chambers 8, 9 of the device 1, the motor oil from the lubricant circulation of the internal combustion engine is provided. As can be clearly seen in both drawings, part of the motor oil provided for lubrication of a device 15 side camshaft slide bearing 41 in the cylinder head 3 of the internal combustion engine is branched off via radial bore holes 42 in the camshaft 5 into an axial channel 43 in the camshaft 5. From this axial channel 43, the motor oil is then either, as shown in FIG. 1, conducted further through an axial passage hole 44 of the threaded part 33 of the mounting bolt 31 or, as shown in FIG. 2, conducted directly into the cavity 10 in the axial structural part 11 of the device 1, as well as supplied via a bore hole in the housing 16 of the hydraulic control element 12 to its control piston. The oil channels are depicted in dashed lines and not indicated in greater detail in the structural component affixed to the camshaft of the device 1 and clearly show in both FIGS. 1 and how the motor oil is conducted further to the pressure chambers 8, 9 of the device 1 and is branched off from them into the chain bay 2 of the cylinder head 3 of the internal combustion engine.

Figure 3:
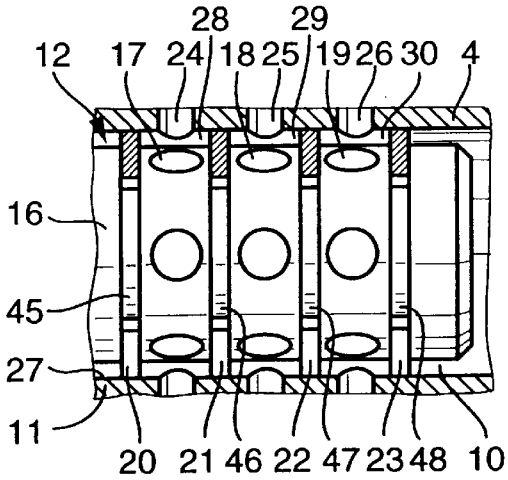
FIG. 3 is an enlarged representation of the area designated X in FIGS. 1 and 2.

Finally, in FIG. 3, it can in addition be seen that the sealing elements 20, 21, 22, 23, which are depicted at a pretension and are made from consisting of a material resistant to shearing, are arranged in the surrounding ring grooves 45, 46, 47, 48 on the circumference of the hydraulic control element 12 and are constructed as slitted steel sealing rings having a rectangular cross-section. These steel sealing rings have an outer diameter, which can be reduced by the slit while generating the pretension, to the diameter of the cavity 20 of the axial structural part 11 of the device 1, and they are arranged with a radial as well as an axial play in the respective ring groove 45, 46, 47, 48, such that they have a larger inner diameter than the ring groove inner diameter as well as a smaller thickness than the ring groove width. In this way, by a radial force resulting from the pretension of the sealing elements 20, 21, 22, 23 and/or a dynamic sealing force resulting from pressure differences between the ring chambers 28, 29, 30 formed, both leakages between the sealing elements 20, 21, 22, 23 and the hydraulic control element 12 as well as leakages between the sealing elements 20, 21, 22, 23 and the inner wall 27 of the cavity 10 of the axial structural part 11 of the device 1, are sealed off.

What is claimed is:

1. Device for the relative rotation of a camshaft relative to a crankshaft which drives the camshaft of an internal combustion engine, wherein:

the device (1) is attached on a drive-side end (4) of the camshaft (5) which projects into a chain bay (2) of a cylinder head (3) of the engines and comprises a hydraulic adjusting drive, the device (1) comprising a structural component (6) that is adapted to be drivingly connected with the crankshaft of the internal combustion engine and a structural component (7) adapted to be connected to the camshaft (5) in a rotationally fixed manner, the structural component (6) which is adapted to be drivingly connected to the crankshaft is in force transferring connection with the structural component (7) that is affixed to the camshaft, and can be acted upon alternatingly or simultaneously by a hydraulic pressure agent through two pressure chambers (8, 9) located within the device (1) such that the structural components (6, 7) can be rotated or fixed in position relative to each other, the pressure agent supply and return Lo and from the pressure chambers (8, 9) being controlled by a hydraulic control element (12) arranged coaxially to a longitudinal axis of the camshaft in a cavity (10) of an axial structural component (11) of the device (1), the hydraulic control clement (12) is activatable through an adjusting element (14) attached to an opposing housing part (13) of the chain bay (2) in a position aligned with an extension of the camshaft longitudinal axis as a function of the operating parameters of the internal combustion engine, the hydraulic control element (12) is constructed as a fixed hydraulic part of an adjustable hydraulic valve (15), which is arranged starting from the adjusting element (14) attached to the housing part (13) of the chain bay (2), projecting into the cavity (10) of the axial structural component (11) of the device (1), the hydraulic control element (12) has a housing (16) attached to the adjusting element (14) having at least three radial openings (17, 18, 19) distributed circumferentially as well as axially displaced from each other, which arc separated from each other hydraulically by at least four ring-shaped sealing components (20, 21, 22, 23) that enclose the hydraulic control element (12), the axial structural component ( 11) of the device (1) has at least three opposing radial bore holes (24, 25, 26) that are distributed over an outer sheath surface of the axial structural component (11) and are also axially displaced from each other, opening into the cavity (10), which are provided for pressure agent supply and return to and from the pressure chambers (8, 9) of the device (1), and the sealing components (20, 21, 22, 23) of the hydraulic control element (12) forming together with an inner wall (27) of the cavity (10) of the axial structural component (11), several ring chambers (28, 29, 30), through which every one of the at least three radial bore holes (24, 25, 26) in the axial structural component (11) of the device (1) is each hydraulically connected to one of the at least three radial openings (17, 18, 19) in the hydraulic control element (12).

2. Device according to claim 1, wherein in that the adjusting component (14) of the hydraulic control element (12) is constructed as an electromagnet and the hydraulic control element (12) is constructed as a directly controlled proportional directional valve, which consists of a hollow cylindrical cartridge and a control piston that can be moved axially inside the cartridge.

3. Device according to claim 1, wherein the axial structural component (11) of the device (1), constructed with the cavity (10) for receiving the hydraulic control element (12) comprises a mounting bolt (31) having a head (35) for the rotationally fixed connection of the structural component (7) to the camshaft (5), which can be screwed into a threaded bore hole (32) in the camshaft (5) located coaxially to the camshaft longitudinal axis and the mounting bolt having a threaded part (33) with an increased diameter shaft part (34), in which the cavity (10) constructed as an axial bore hole is arranged for the hydraulic control element, the increased diameter shaft part (34) of the mounting bolt (31) has a smaller diameter than the camshaft (5), and the structural component (7), affixed to the camshaft and arranged on the increased diameter shaft part (34), can be clamped through the head (35) of the mounting bolt (31) against a face side (36) of the drive-side end (4) of the camshaft (5).

4. Device according to claim 1, wherein the axial structural component (11) of the device (1), constructed with the cavity (10) for receiving the hydraulic control element (12), is formed directly in the drive-side end (4) of the camshaft (5), the camshaft (5) has an extension, in which the cavity (10) constructed as an axial bore hole is arranged, the extension has a slightly reduced-diameter end area (37) with a threaded section (38), on which for rotationally fixed connection of the structural component (7) to the camshaft (5), a ring-shaped mounting nut (39) is screwed, the structural component (7) affixed to the camshaft and arranged in the reduced diameter end area (37) is clamped against a ring shoulder (40) on the camshaft (5) formed by the diameter reduction by the ring-shaped mounting nut (39).

5. Device according to claim 3, wherein a hydraulic pressure agent for acting upon the pressure chambers (8, 9) of the device (1), motor oil from the lubricant circulation of the internal combustion engine is provided, which starting from an oil supply of a device-side camshaft slide bearing (41) in the cylinder head (3) of the internal combustion engine, is branched off via radial bore holes (42) in the camshaft (5) into an axial channel (43) in the camshaft (5), an axial passage hole (44) is formed in the threaded part (33) of the mounting bolt (31) through which the motor oil from the axial channel (43) is adapted to pass into the cavity (10), and supplied from this cavity (10) via a bore hole on a face side in the housing (16) of the hydraulic control element (12) to a control piston.

6. Device according to claim 1, wherein the sealing elements (20, 21, 22, 23) are constructed with a pretension and are made of a material that is resistant to shearing and are arranged in surrounding ring grooves (45, 46, 47, 48) on a circumference of the hydraulic control element (12), such that due to the pretension of the sealing elements (20, 21, 22, 23), a radial force results, and by a dynamic sealing force resulting from pressure differences between the ring chambers (28, 29, 30) formed, both leakages between the sealing elements (20, 21, 22, 23) and hydraulic control element (12), as well as leakages between the sealing elements (20, 21, 22, 23) and the inner wall (27) of the cavity (10) of the axial structural component (11) of the device are sealed off.

7. Device according to claim 6, wherein the sealing elements (20, 21, 22, 23)

are constructed as slitted steel sealing rings having one of a square and a rectangular cross-section, having an outer diameter, which can be reduced to generate the pretension, at least to the diameter of the cavity (10) of the axial structural component (11) of the device (1), and are dimensioned to have a radial as well as an axial play in the respective ring groove (45, 46, 47, 48) in the hydraulic control element (12), such that the sealing elements have a larger inner diameter than an inner diameter of the ring groove as well as a smaller thickness than a width of the ring groove.

8. Device according to claim 4, wherein a hydraulic pressure agent for acting upon the pressure chambers (8, 9) of the device (1), motor oil from the lubricant circulation of the internal combustion engine is provided, which starting from an oil supply of a device-side camshaft slide bearing (41) in the cylinder head (3) of the internal combustion engine, is branched off via radial bore holes (42) in the camshaft (5) into an axial channel (43) in the camshaft (5), directly into the cavity (10) in the axial structural component (11) of the device (1), and supplied from this cavity (10) via a bore hole on a face side in the housing (16) of the hydraulic control element (12) to a control piston.

* * * * *